US006796333B2

(12) United States Patent
Birkel et al.

(10) Patent No.: US 6,796,333 B2
(45) Date of Patent: Sep. 28, 2004

(54) PROTECTIVE PACKING STRUCTURE FOR A CYLINDRICAL OBJECT AND FITTED WITH A FASTENER

(75) Inventors: Thierry Birkel, Vandoeuvre les Nancy (FR); Serge Arduini, Heillecourt (FR)

(73) Assignee: ITW Litec France & Serge Arduini (FR)

( * ) Notice: Subject to any disclaimer, the term of this patent is extended or adjusted under 35 U.S.C. 154(b) by 257 days.

(21) Appl. No.: 09/950,922

(22) Filed: Sep. 13, 2001

(65) Prior Publication Data

US 2002/0063428 A1 May 30, 2002

(30) Foreign Application Priority Data

Sep. 14, 2000 (FR) ..... 00 11703

(51) Int. Cl.[7] ..... F16L 57/00
(52) U.S. Cl. ..... 138/96 R; 138/110; 138/109
(58) Field of Search ..... 138/96 R, 96 T, 138/109, 110

(56) References Cited

U.S. PATENT DOCUMENTS

| | | | | |
|---|---|---|---|---|
| 1,498,563 A | * | 6/1924 | Morrison | 138/96 R |
| 1,762,248 A | * | 6/1930 | Shrum | 138/96 R |
| 2,471,209 A | | 5/1949 | Gazdik | 138/103 |
| 2,708,453 A | | 5/1955 | Das | 138/96 R |
| 2,918,165 A | | 12/1959 | Paulik | 206/349 |
| 4,349,048 A | * | 9/1982 | Clark | 138/96 T |
| 5,524,672 A | | 6/1996 | Mosing et al. | 138/96 T |
| 5,819,805 A | | 10/1998 | Mosing et al. | 138/96 T |
| 6,332,478 B1 | * | 12/2001 | Holden et al. | 138/96 R |

FOREIGN PATENT DOCUMENTS

| | | |
|---|---|---|
| DE | 2000 00 467 | 5/2001 |
| GB | 834061 | 5/1960 |

* cited by examiner

*Primary Examiner*—Patrick Brinson
(74) *Attorney, Agent, or Firm*—Lowe Hauptman Gilman & Berner LLP

(57) ABSTRACT

A packing structure for protecting a cylindrical object includes an integrated fastener, the packing structure assuming the form of a collar hooping the object to be protected and being characterized in that the collar includes over at least a large portion of its periphery at least one at least partly closed housing (4) which is designed to receive and retain on the collar the fastener (2) which shall enclose and tighten the collar, the housing being a channel fitted with two lips, the fastener (2) being inserted between these lips. In the packing structure for protecting the end of a cylindrical object, the collar is fitted with a substantially right-angle flange (5) covering the end segment of the object to be protected.

22 Claims, 2 Drawing Sheets

PROTECTIVE PACKING STRUCTURE FOR A CYLINDRICAL OBJECT AND FITTED WITH A FASTENER

FIELD OF THE INVENTION

The invention relates to a protective packing structure for a cylindrical object and fitted with an integrated fastener.

BACKGROUND OF THE INVENTION

In order to protect the ends of a cylindrical object such as a pipe, a coil or the like when being shipped or stored, said end heretofore has been enclosed by an angled protector or a case affixed by a hoop.

Such a protective means which does not specifically match the diameter of the object to be protected and which while hooping must be kept in placed and must be handled simultaneously with its hooping means manifestly offers questionably efficacy and foremost hampers handling.

In some applications and as is known from the British patent 834,061, a cylindrical-object protective packing structure is known which comprises an integrated fastener and which assumes the shape of a collar hooping the object to be protected. This packing structure consists of a layer of wood chips, said layer being clad by a cloth, a wire being inserted between said layer of chips and the inside surface of said cloth.

In this embodiment, the tension in the wire should be maintained while the layer of chips expands and contracts. Obviously this technique also entails a multilayer composite of specific materials.

SUMMARY OF THE INVENTION

Therefore the inventors' goal has been a practical and efficient means which matches homogeneous as well as inhomogeneous materials.

For that purpose the inventors conceived a protective packing structure for a cylindrical object, fitted with an integrated fastener and in the form of a collar retaining the said object but being characterized in that it is fitted at least over a large portion of its periphery with at least one at least partly closed housing to receive an retain at the collar the said fastener enclosing and clamping it.

Advantageously the fastener is a hoop or the like whereas the collar is a strip of which the length is selected in relation to the desired collar diameter and of which the ends are joined to one another.

Illustratively the collar-constituting strip is made of plastic and its ends are mutually fused together.

The collar's housing may be away from the ends' junction to keep these ends free.

In one embodiment mode, the housing retaining the fastener consists of a channel on the collar's periphery, said channel comprising two lips partly closing it and the fastener being inserted between these lips.

The fastener's retaining housing also may be in the form of an elongated cap on the collar periphery which is bent onto said fastener and is fused at its free tip, or said retention housing may be a closed space on or in the collar's periphery to receive said fastener.

Preferably at least the inside collar surface that shall be in contact with the object to be protected shall be fitted with an anti-slip cladding and/or with protrusions or salients and/or the collar material shall be at least partly an anti-slip material.

It is understood that a packing structure of the invention may be used at different sites on the cylindrical object to be protected.

However, when protecting the end of a cylindrical object, the collar shall advantageously comprise a substantially right-angle flange to cover the end segment of the object to be protected.

In the latter case, the right-angle flange advantageously shall be fitted with regularly recurring cutouts to allow the flange to bend and according to one embodiment mode, the cutouts of this flange shall be a sequence of isosceles trapezoids, the edge subtended between the collar and its right-angle flange for instance being reinforced by an external rib.

In another embodiment of the invention, the collar comprises a thinner edge opposite its right-angle flange.

BRIEF DESCRIPTION OF THE DRAWINGS

The invention and its other features are elucidated in the following description and in relation to the attached drawings.

DETAILED DESCRIPTION OF THE INVENTION

Figure 1:
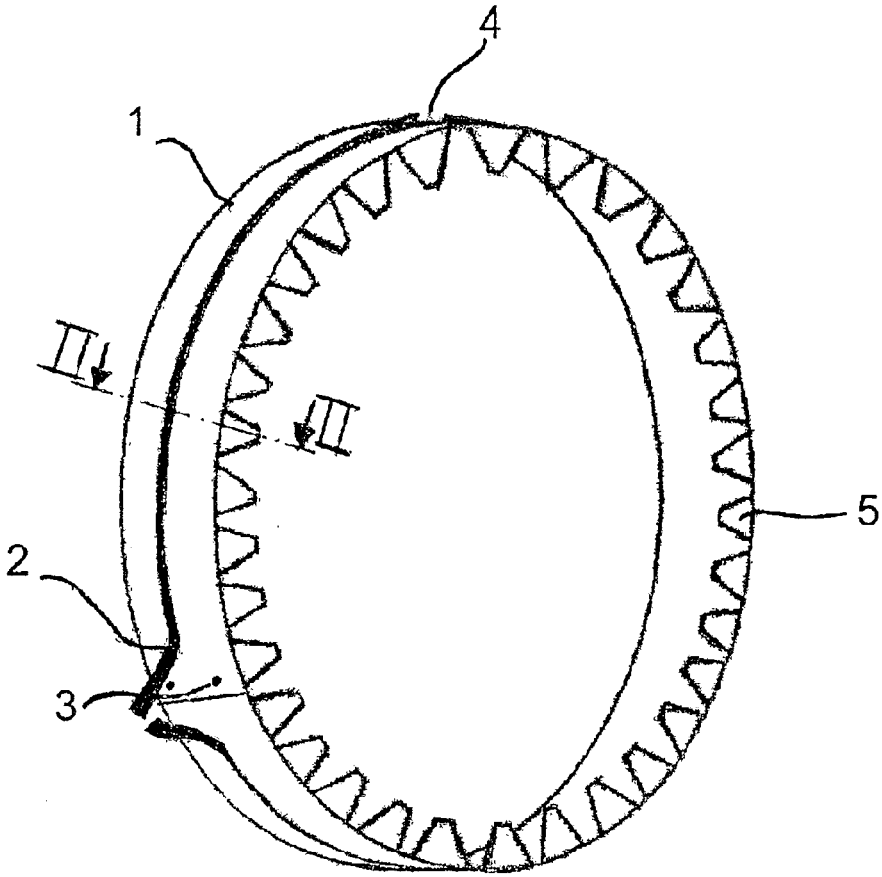
FIG. 1 is a perspective of one embodiment of the invention.

FIG. 1 shows a packing structure of the invention in the form of a collar made from a strip 1 for instance of polyethylene, polypropylene, cardboard or other material, said strip being fitted with a housing to seat a fastener such as a hoop 2.

The strip ends are joined to each other in relation to the collar's diameter, for instance by fusion especially as regards a plastic as indicated by 3 in FIG. 1.

Figure 4:
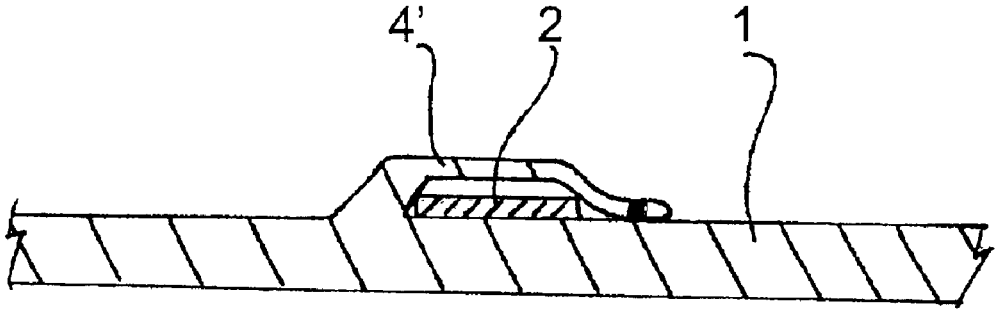
FIGS. 4, 5 correspond to FIG. 3 and are slight embodiment variations.
Figure 5:
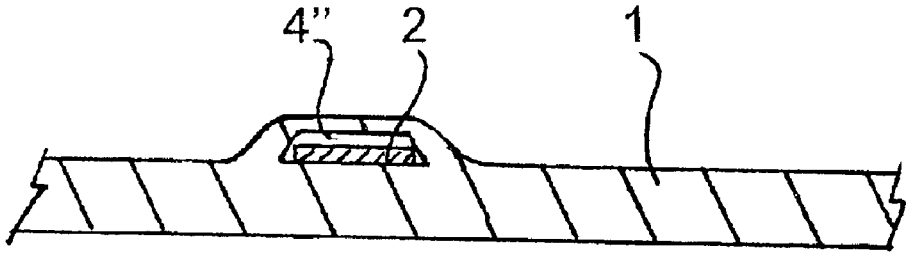

The hoop's housing illustratively assumes the form of a channel 4 (FIGS. 1 through 3) or of a cap 4' (FIG. 4) covering the collar and above said hoop and fused by its free end, or in the form of a closed space 4" (FIG. 5).

As shown in FIG. 1, the hoop's housing 4 runs circularly over a large portion of the collar.

However, and as also shown in FIG. 1, the channel 4 is eliminated at and near the fusion 3 of the ends of the strip 1 for the purpose of freeing the hoop's ends which shall be mutually affixed by any known means (collar . . . ) after said hoop has been tightened.

Figure 2:
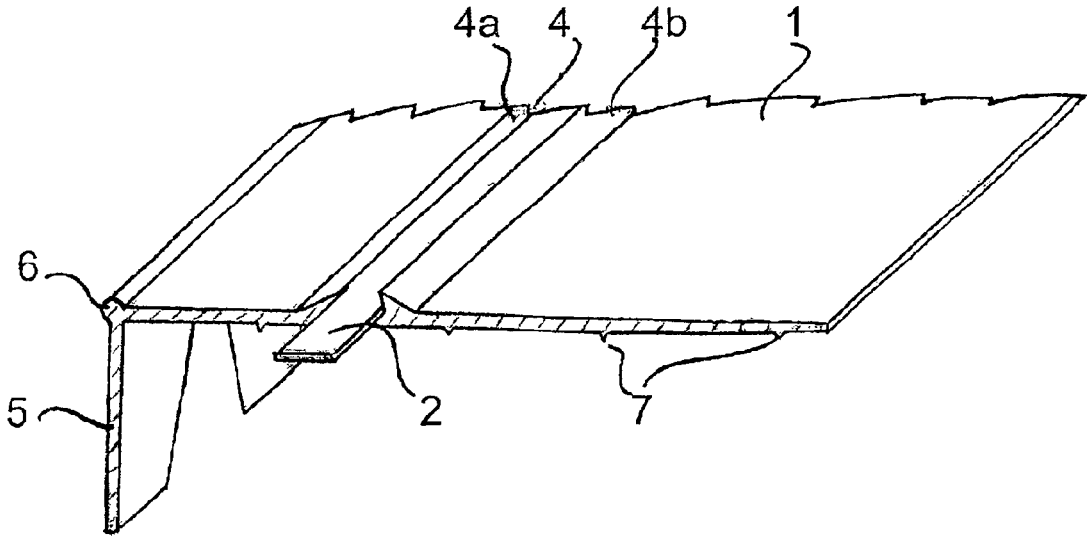
FIG. 2 is a perspective section along II—II of FIG. 1.
Figure 3:
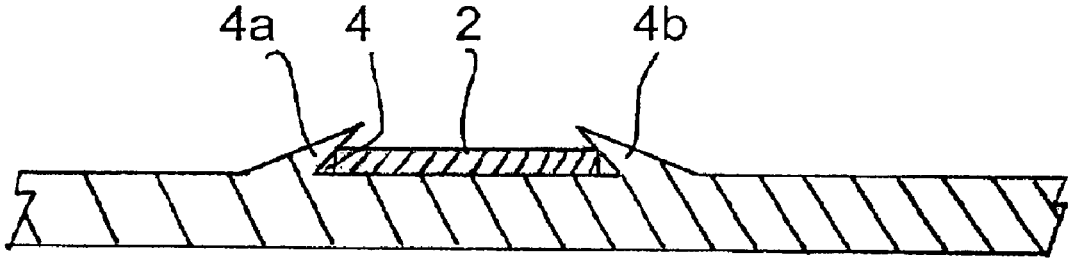
FIG. 3 is a partial enlargement and an elevation of FIG. 2.

As regards the more specific embodiment of FIGS. 1 through 3, the channel 4 consists of two lips 4*a*, 4*b* partly closing said channel and retaining the hoop after its insertion between them (illustratively near the fusion 3, the lips 4*a*, 4*b* shall be trimmed to eliminate the channel 4 for the above reasons).

While, in this embodiment mode, the lips 4*a*, 4*b* do subtend said channel 4, this channel of course also may be subtended within the strip and comprise lip forming edges.

It is understood that such a collar may enclose and clamp any cylindrical object such as a pipe, a tube, a coil or the like in order to protect it, though specifically the invention is intended to protect the end of such a cylindrical object.

For that purpose the strip 1 that shall constitute the collar is fitted with a substantially right-angle flange 5 which preferably shall be cut out at regular spacings to allow bending it around a circular edge.

In the shown embodiment mode, the cutouts of the right-angle flange 5 are a series of isosceles trapezoids.

Furthermore, FIG. 2 shows that the edge joining the collar to the right-angle flange 5 is reinforced by an external rib 6.

FIG. 2 shows that, in order to easily put the collar on the object, the collar edge opposite the flange 5 is thinner, in this instance by means of a bevel from its inside surface to its upper surface.

Ast least the collar's inside surface may be fitted with an anti-slip cladding and/or protrusions or salients such as 7 (FIG. 2) in order to assure gripping the object to be protected. Instead, or in addition, the material used for the collar may be at least in part an anti-slip material.

Many embodiment variations manifestly may be employed without thereby transcending the scope of the present invention.

Also, when the above described embodiment includes a hoop, this term must be construed broadly, and this hoop of course also may be replaced by any other means such as a plastic tape, a cable etc.

What is claimed is:

1. A protective packing structure for a cylindrical object, said packing structure comprising:

a fastener; and a collar for hooping the object to be protected, wherein said collar comprises at least one housing over a portion of a periphery of said collar, said housing being at least partly closed and configured to receive and retain onto the collar the fastener used to enclose and tighten said collar;

wherein said collar has opposite edges and a thickness that tapers in a direction from said housing toward one of said edges.

2. The packing structure as claimed in claim 1, wherein the fastener is a hoop.

3. A protective packing structure for a cylindrical object, said packing structure comprising:

a fastener; and a collar for hooping the object to be protected, wherein said collar comprises at least one housing over a portion of a periphery of said collar, said housing being at least partly closed, said housing receiving and retaining onto the collar the fastener used to enclose and tighten said collar;

wherein the collar is in the form of a strip of a length that is selected in relation to a desired diameter of the collar; and wherein the strip is made of plastic and has ends that are mutually fused.

4. The packing structure as claimed in claim 3, wherein the collar is devoid of said housing in a vicinity of a junction of said ends in order to free ends of the fastener.

5. The packing structure as claimed in claim 1, wherein the housing comprises a channel formed in the periphery of said collar and comprising two lips which partially close said channel, said fastener being inserted between said two lips.

6. A protective packing structure for a cylindrical object, said packing structure comprising:

a fastener; and a collar for hooping the object to be protected, wherein said collar comprises at least one housing over a portion of a periphery of said collar, said housing being at least partly closed, said housing receiving and retaining onto the collar the fastener used to enclose and tighten said collar;

wherein the housing has a cap situated on the periphery of said collar, covering said fastener, and being fused at a free end segment thereof.

7. The packing structure as claimed in claim 1, wherein the housing is a closed space situated on or in the periphery of said collar, said fastener being inserted into said closed space.

8. The packing structure as claimed in claim 3, wherein at least an inside surface of said collar, which surface is adapted to be in contact with the object to be protected, is provided with an anti-slip cladding.

9. The packing structure as claimed in claim 3, wherein at least an inside surface of said collar, which surface is adapted to make contact with the object to be protected, is provided with protrusions or salients.

10. The packing structure as claimed in claim 3, wherein at least part of the collar is made of anti-slip material.

11. The packing structure as claimed in claim 1, further comprising, in order to protect an end segment of said object, a flange at a substantially right angle relative to said collar for covering the end segment of said object to be protected.

12. The packing structure as claimed in claim 11, wherein the flange is cut out in regularly recurring manner so as to be bendable.

13. The packing structure as claimed in claim 11, wherein the flange comprises a sequence of isosceles trapezoids.

14. A protective packing structure for a cylindrical object, said packing structure comprising:

a fastener;

a collar for hooping the object to be protected, wherein said collar comprises at least one housing over a portion of a periphery of said collar, said housing being at least partly closed, said housing receiving and retaining onto the collar the fastener used to enclose and tighten said collar; and a flange at a substantially right angle relative to said collar for covering an end segment of said object to be protected;

wherein an edge constituting a junction between the collar and said flange is reinforced by an external rib.

15. The packing structure as claimed in claim 1, wherein the collar is in the form of a strip of a length that is selected in relation to a desired diameter of the collar, said strip having ends that are permanently bonded to each other.

16. The packing structure as claimed in claim 15, wherein the strip is made of plastic and said ends are fused to each other.

17. The packing structure as claimed in claim 1, wherein the housing has a cap situated on the periphery of said collar, covering said fastener, and having a free end segment being fused to said collar.

18. The packing structure as claimed in claim 1, wherein at least an inside surface of said collar, which surface is adapted to be in contact with the object to be protected, is provided with one selected from the group consisting of an anti-slip cladding, protrusions and salients.

19. The packing structure as claimed in claim 1, wherein at least part of the collar is made of anti-slip material.

20. The packing structure as claimed in claim 11, wherein the collar and the flange are connected at the other edge of said collar.

21. The packing structure as claimed in claim 20, wherein the other edge of said collar is reinforced by an external rib.

22. The packing structure as claimed in claim 1, wherein said collar has an inner surface which is adapted to contact the object to be protected and an outer surface on which said housing is formed, said inner surface having a truncated conical section that flares toward said edge so that said collar can be easily put on the object to be protected.

* * * * *